US009329513B2

(12) United States Patent
Kobayashi et al.

(10) Patent No.: US 9,329,513 B2
(45) Date of Patent: May 3, 2016

(54) POSITIVELY CHARGEABLE TONER AND MANUFACTURING METHOD THEREFOR

(71) Applicant: KYOCERA Document Solutions Inc., Osaka (JP)

(72) Inventors: Ryota Kobayashi, Osaka (JP); Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/549,798

(22) Filed: Nov. 21, 2014

(65) Prior Publication Data

US 2015/0153664 A1 Jun. 4, 2015

(30) Foreign Application Priority Data

Nov. 29, 2013 (JP) ..... 2013-246922
Dec. 9, 2013 (JP) ..... 2013-254233

(51) Int. Cl.
*G03G 9/097* (2006.01)

(52) U.S. Cl.
CPC ..... *G03G 9/09725* (2013.01); *G03G 9/09716* (2013.01)

(58) Field of Classification Search
CPC ..... G03G 9/0935; G03G 9/09392; G03G 9/09716; G03G 9/09725
See application file for complete search history.

(56) References Cited

FOREIGN PATENT DOCUMENTS

JP H10-039534 A 2/1998
JP 2005-321690 A 11/2005

*Primary Examiner* — Hoa V Le
(74) *Attorney, Agent, or Firm* — Studebaker & Brackett PC

(57) ABSTRACT

A positively chargeable toner includes a plurality of toner particles each having a toner mother particle and an external additive adhering to a surface of the toner mother particle. The external additive contains silica particles and coat layers on a surface of the respective silica particles. The coat layers contain a mixture of a nitrogen-containing resin and a chargeable treatment agent.

15 Claims, 2 Drawing Sheets

POSITIVELY CHARGEABLE TONER AND MANUFACTURING METHOD THEREFOR

INCORPORATION BY REFERENCE

The present application claims priority under 35 U.S.C. §119 to Japanese Patent Application No. 2013-246922, filed Nov. 29, 2013 and Japanese Patent Application No. 2013-254233, filed Dec. 9, 2013. The contents of the applications are incorporated herein by reference in their entirety.

BACKGROUND

The present disclosure relates to a positively chargeable toner and a manufacturing method for the toner.

A toner contains a plurality of toner particles. The toner particles may contain an external additive adhering to the surface thereof for imparting fluidity to the toner, optimizing the amount of electric charge of the toner, or rendering the toner easily cleanable, for example. A preferable example of the external additive is silica particles having diameters ranging from several to several tens of nanometers.

Specifically, a known technology involves coating the surface of silica particles with an amino-denatured silicone oil having stronger positive chargeability than a silicone oil.

SUMMARY

According to the present disclosure, a positively chargeable toner includes a plurality of toner particles each having a toner mother particle and an external additive adhering to a surface of the toner mother particle. The external additive contains silica particles and coat layers on a surface of the respective silica particles. The coat layers contain a mixture of a nitrogen-containing resin and a chargeable treatment agent.

According to the present disclosure, a method for manufacturing a positively chargeable toner is for manufacture of a positively chargeable toner that includes a plurality of toner particles each having a toner mother particle and an external additive adhering to a surface of the toner mother particle. According to the present disclosure, the method for manufacturing the positively chargeable toner involves: preparing silica particles to be contained in the external additive; and forming, on a surface of each of the silica particles, a coat layer containing a mixture of a nitrogen-containing resin and a chargeable treatment agent.

DETAILED DESCRIPTION

The following describes an embodiment of the present disclosure.

A toner according to the present embodiment is a positively chargeable toner for developing an electrostatic image. The toner according to the present embodiment is powder that includes a large number of particles (hereinafter referred to as toner particles). The toner according to the present embodiment can be used in an electrophotographic apparatus (image forming apparatus), for example.

The following explains an example of a method for forming an image by an electrophotographic apparatus. First, based on image data, an electrostatic image is formed on a photosensitive member. Next, the electrostatic image thus formed is developed with a developer containing a toner. In the developing process, the electrically charged toner is caused to adhere to the electrostatic image. Then, the toner caused to adhere to the electrostatic image is transferred onto a transfer belt as a toner image. The toner image on the transfer belt is subsequently transferred onto a recording medium (for example, paper) and is fixed to the recording medium through heating. Through the above processes, an image is formed on the recording medium. For example, a full-color image can be obtained by superimposing toner images of four different colors, namely black, yellow, magenta, and cyan.

Figure 1:
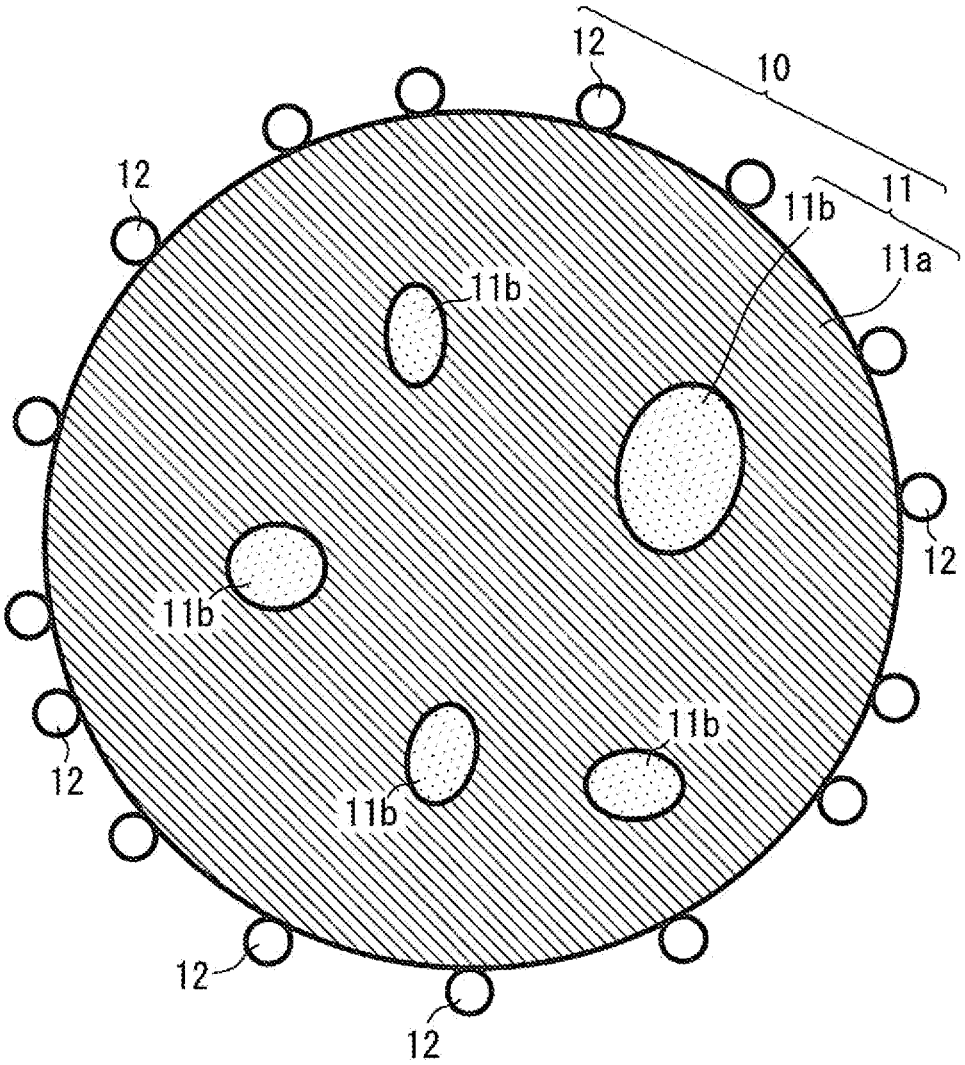
FIG. 1 shows one of toner particles contained in a toner according to an embodiment of the present disclosure.

With reference to FIG. 1, the following explains composition of the toner (in particular, the toner particles) according to the present embodiment. FIG. 1 shows one of toner particles 10 included in the toner according to the present embodiment.

As shown in FIG. 1, the toner particle 10 has a toner mother particle 11 and an external additive 12. The external additive 12 adheres to the surface of the toner mother particle 11.

The toner mother particles may be encapsulated. Encapsulated toner mother particles include, for example, a core having the same composition as the toner mother particle 11 shown in FIG. 1 and a shell layer (capsule layer) on the surface of the core.

The following describes the toner mother particles 11 according to the present embodiment. Note that a generic term "(meth)acryl" may be used to refer to both acryl and methacryl.

Each of the toner mother particles 11 contains a binder resin 11*a* and an internal additive 11*b* (for example, a colorant, a releasing agent, and a charge control agent). Optional components (for example, the colorant, the releasing agent, or the charge control agent) may be omitted in accordance with intended use of the toner. The toner mother particles 11 may additionally contain a magnetic powder as necessary.

Preferably, the toner mother particles 11 have a number average particle diameter of at least 5 μm and no greater than 10 μm.

[Binder Resin]

To improve the fixability of the toner, a thermoplastic resin is preferable as the binder resin 11*a*. Preferable examples of thermoplastic resins that can be used as the binder resin 11*a* include styrene-based resins, acrylic-based resins, styrene-acrylic-based resins, polyethylene-based resins, polypropylene-based resins, vinyl chloride-based resins, polyester resins, polyamide resins, polyurethane resins, polyvinyl alcohol-based resins, vinyl ether-based resins, N-vinyl-based resins, and styrene-butadiene-based resins. To improve the dispersibility of the colorant in the binder resin 11*a*, the chargeability of the toner, or the fixability of the toner, a styrene-acrylic-based resin or a polyester resin is more preferable as the binder resin 11*a*. The following describes a styrene-acrylic-based resin and a polyester resin.

The styrene-acrylic-based resin is a copolymer of a styrene-based monomer and an acrylic-based monomer. Preferable examples of styrene-based monomers that can be used in preparation of the styrene-acrylic-based resin (binder resin 11*a*) include styrene, α-methylstyrene, vinyltoluene, α-chlorostyrene, o-chlorostyrene, m-chlorostyrene, p-chlorostyrene, and p-ethylstyrene. Preferable examples of acrylic-based monomers that can be used in the preparation of the styrene-acrylic-based resin (binder resin 11*a*) include alkyl esters of (meth)acrylic acid, such as methyl (meth)acrylate, ethyl (meth)acrylate, n-propyl(meth)acrylate, iso-propyl (meth)acrylate, n-butyl (meth)acrylate, iso-butyl (meth)acrylate, and 2-ethylhexyl(meth)acrylate.

The polyester resin used as the binder resin 11*a* can be obtained through condensation polymerization or condensation copolymerization of an alcohol and a carboxylic acid, for example.

When the binder resin 11*a* is a polyester resin, preferable example of the alcohol used in preparation of the polyester resin include diols, bisphenols, and alcohols having three or more hydroxyl groups.

Preferable examples of diols that can be used in preparation of the polyester resin include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols that can be used in preparation of the polyester resin include bisphenol A, hydrogenated bisphenol A, polyoxyethylenated bisphenol A, and polyoxypropylenated bisphenol A.

Preferable examples of alcohols having three or more hydroxyl groups that can be used in preparation of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin 11*a* is a polyester resin, preferable examples of carboxylic acids that can be used in preparation of the polyester resin include dicarboxylic acids and the carboxylic acids having three or more carboxyl groups.

Examples of dicarboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specifically, n-butyl succinic acid, isobutylsuccinic acid, n-octylsuccinic acid, n-dodecylsuccinic acid, and isododecylsuccinic acid), and alkenyl succinic acids (specifically, n-butenyl succinic acid, isobutenylsuccinic acid, n-octenylsuccinic acid, n-dodecenylsuccinic acid, and isododecenylsuccinic acid).

Specific examples of carboxylic acids having three or more carboxyl groups that can be used in preparation of the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The dicarboxylic acid or carboxylic acid component having three or more carboxyl groups to be used may be modified to an ester-forming derivative such as an acid halide, an acid anhydride, or a lower alkyl ester. Here, the term "lower alkyl" refers to an alkyl group having one to six carbon atoms.

When the binder resin 11*a* is a polyester resin, the softening point of the polyester resin is preferably at least 80° C. and no greater than 150° C., and more preferably at least 90° C. and no greater than 140° C.

The binder resin 11*a* may be composed entirely of a thermoplastic resin. However, the present disclosure is not limited to such, and the thermoplastic resin forming the binder resin 11*a* may additionally contain a cross-linking agent or a thermosetting resin. The presence of a cross-link in the binder resin 11*a* can improve the preservability, shape retention, or durability of the toner while maintaining the high fixability of the toner. Preferable examples of the thermosetting resin that can be added to the thermoplastic resin include bisphenol A epoxy resins, hydrogenated bisphenol A epoxy resins, novolac epoxy resins, polyalkylene ether epoxy resins, cycloaliphatic epoxy resins, and cyanate-based resins. Two or more of the above-listed resins may be used in combination.

The glass transition point (Tg) of the binder resin 11*a* is preferably at least 50° C. and no greater than 65° C., and more preferably at least 50° C. and no greater than 60° C. With the glass transition point (Tg) of the binder resin 11*a* being at least 50° C. and no greater than 65° C., the preservability, shape retention, or durability of the toner can be improved while the high fixability of the toner is maintained.

In one example, the glass transition point (Tg) of the binder resin 11*a* can be measured by a method in which a heat absorption curve of the binder resin 11*a* is obtained by using a differential scanning calorimeter (for example, DSC-6200 manufactured by Seiko Instruments Inc.). Then, Tg of the binder resin 11*a* is calculated from an inflection point of specific heat on the heat absorption curve. In the measurement method of the example, 10 mg of a measurement sample (binder resin 11) is added to an aluminum pan and an empty aluminum pan is used as a reference. The heat absorption curve of the binder resin 11*a* is obtained through measurements in a temperature range from 25° C. to 200° C. and at a heating rate of 10° C./minute. Then, Tg of the binder resin 11*a* is calculated from the heat absorption curve.

[Colorant]

The toner mother particles 11 may contain a colorant as necessary. A commonly known pigment or dye may be used as the colorant in accordance with color of the toner. The amount of the colorant is preferably at least 1 part by mass and no greater than 20 parts by mass with respect to 100 parts by mass of the binder resin 11*a*, and more preferably at least 3 parts by mass and no greater than 10 parts by mass.

(Black Colorant)

The toner mother particles 11 may contain a black colorant. The black colorant is formed from carbon black, for example. Also, a colorant can be used that has been adjusted to a black color using colorants such as a yellow colorant, a magenta colorant, and a cyan colorant.

(Non-Black Colorants)

The toner mother particles 11 may contain a non-black colorant such as a yellow colorant, a magenta colorant, or a cyan colorant.

Preferable examples of yellow colorants include condensed azo compounds, isoindolinone compounds, anthraquinone compounds, azo metal complexes, methine compounds, and arylamide compounds. Preferable examples of yellow colorants include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. vat yellow.

Preferable examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of magenta colorants include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferable examples of cyan colorants include copper phthalocyanine compounds, copper phthalocyanine derivatives, anthraquinone compounds, and basic dye lake compounds. Preferable examples of cyan colorants include C.I. pigment blue (1, 7, 15, 15:1, 15:2, 15:3, 15:4, 60, 62, and 66), phthalocyanine blue, C.I. vat blue, and C.I. acid blue.

[Releasing Agent]

The toner mother particles 11 may contain a colorant as necessary. The releasing agent is used, for example, to improve the fixability or offset resistance of the toner. In order to improve the fixability or the offset resistance of the toner, a preferable amount of the releasing agent to be used is at least 1 part by mass and no greater than 30 parts by mass with respect to 100 parts by mass of the binder resin 11*a*, and more preferably at least 5 parts by mass and no greater than 20 parts by mass.

Preferable examples of the releasing agent include: aliphatic hydrocarbon-based waxes, such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes, such as polyethylene oxide wax and block copolymer of polyethylene oxide wax; plant waxes, such as candelilla wax, carnauba wax, Japan wax, jojoba wax, and rice wax; animal waxes, such as beeswax, lanolin, and spermaceti; mineral waxes, such as ozocerite, ceresin, and petrolatum; waxes having a fatty acid ester as major component such as montanic acid ester wax or castor wax; and waxes, such as deoxidized carnauba wax in which a part or all of a fatty acid ester has been deoxidized.

[Charge Control Agent]

The toner mother particles 11 may contain a charge control agent as necessary. The charge control agent is used for example to improve the charge stability or the charge rise characteristic of the toner. The charge rise characteristics serve as an index indicating whether the toner can be charged to a predetermined charge level within a short period of time. The presence of a positively chargeable charge control agent in the toner mother particles 11 can improve the cationic nature of the toner. The presence of a negatively chargeable charge control agent in the toner mother particles 11 can improve the anionic nature of the toner.

Specific examples of the positively chargeable charge control agent include: azine compounds, such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes made from an azine compound, such as azine fast red FC, azine fast red 12BK, azine violet BO, azine brown 3G, azine light brown GR, azine dark green BH/C, azine deep black EW, and azine deep black 3RL; nigrosine compounds, such as nigrosine, nigrosine salt and nigrosine derivative; acidic dyes made from a nigrosine compound, such as nigrosine BK, nigrosine NB, or nigrosine Z; metal salts of naphthenic acid or higher organic carboxylic acid; alkoxylated amine; alkylamide; and quaternary ammonium salts, such as benzyldecylhexylmethyl ammonium chloride and decyltrimethyl ammonium chloride. In order to improve the charge rise characteristics, a nigrosine compound is preferable from among the positively chargeable charge control agents listed above. Note that two or more of the positively chargeable charge control agents may be used in combination.

Specific examples of the negatively chargeable charge control agent include organic metal complexes or chelate compounds. Preferable examples of the organic metal complex and the chelate compound include: acetylacetone metal complexes, such as aluminum acetylacetonate and iron(II) acetylacetonate; salicylic acid-based metal complexes, such as 3,5-di-tert-butylsalicylic acid chromium; and salicylic acid-based metal salts. In particular, salicylic acid-based metal complex or salicylic acid-based metal salt are more preferable. Note that two or more of the negatively chargeable charge controlling agents listed above may be used in combination.

The amount of charge control agent is preferably at least 1.5 parts by mass and no greater than 15 parts by mass with respect to 100 parts by mass of the toner, and more preferably at least 2.0 parts by mass and no greater than 8.0 parts by mass, and further more preferably at least 3.0 parts by mass and no greater than 7.0 parts by mass.

[Method for Preparing Toner Mother Particles]

Preferable examples a method for preparing the toner mother particles 11 include a pulverization method and an aggregation method.

In one example of the pulverization method, a binder resin, a colorant, a charge control agent, and a releasing agent are mixed first. Subsequently, the resultant mixture is melt-knead using a melt-kneading device, such as a one- or two-screw extruder. The resultant melt-knead produce is pulverized and classified. As a result, the toner mother particles 11 are obtained.

In one example of the aggregation method, particulates of each of a binder resin, a releasing agent, and a colorant are caused to aggregate in an aqueous medium. Then, the resultant aggregated particles are heated to cause the components contained in the aggregated particles to coalesce. As a result, the toner mother particles 11 are obtained.

[External Additive]

Figure 2:
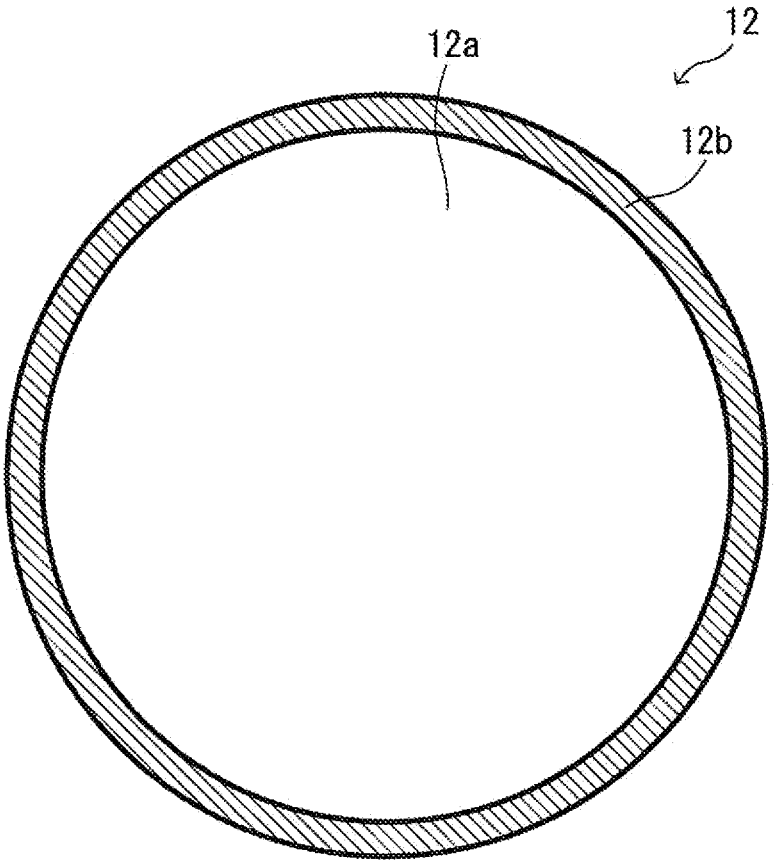
FIG. 2 shows one of particles of an external additive being a component of a toner particle of the toner according to an embodiment of the present disclosure.

The following explains the external additive 12, with reference mainly to FIG. 2.

The external additive 12 contains silica particles 12*a* and coat layers 12*b* mainly formed from a resin. Each coat layer 12*b* is formed on the surface of a silica particle 12*a*. Each silica particle 12*a* is coated with a coat layer 12*b*.

The toner according to the present embodiment is a positively chargeable toner. According to the present embodiment, the toner mother particles 11 are cationic (positively chargeable). Also according to the present embodiment, the silica particles 12*a* are anionic (negatively chargeable), and the coat layers 12*b* are cationic (positively chargeable). Silica has a silanol group and thus has a tendency of being negatively charged. According to the present embodiment, however, the surface of each silica particle 12*a* is coated with a cationic coat layer 12*b*. This can stably ensure the toner to be positively charged to a level falling within a desired range.

The external additive 12, which is added to improve the fluidity or the handleability of the toner, adheres to the surface of the toner mother particles 11. In order to improve the fluidity or handleability of the toner, the amount of the external additive 12 is preferably at least 1 part by mass and no greater than 10 parts by mass with respect to 100 parts by mass of the toner mother particles, and more preferably at least 1.5 parts by mass and no greater than 5 parts by mass. Also, in order to improve the fluidity or handleability of the toner, the external additive 12 preferably has a particle diameter of at least 0.01 nm and no greater than 1.0 nm.

(Silica Particles)

The silica particles 12*a* are preferably hydrophilic. The silica particles 12*a* are preferably fumed silica particles. The surfaces of the silica particles 12*a* may be treated to be hydrophilic. The silica particles 12*a* preferably have hydroxy groups on the surface.

(Coat Layer)

The coat layers 12*b* contain a mixture of a nitrogen-containing resin and a chargeable treatment agent (hereinafter, referred to as a "resin mixture"). The chargeable treatment agent may be a positively chargeable treatment agent or a negatively chargeable treatment agent. Since the coat layers 12*b* contain the nitrogen-containing resin and the chargeable treatment agent together as a mixture rather than separately, the charge stability of the toner can be improved. In addition, the coat layers 12*b* containing a nitrogen-containing resin tends to exhibit high chargeability in a high-humidity environment (80% RH for example) substantially comparable to that in a normal humidity environment. This is assumed to be due to the strong hydrophobic nature of the nitrogen-containing resin.

The coat layers 12*b* preferably contain a resin mixture in an amount of at least 80% by mass, and more preferably at least 90% by mass, and more preferably 100% by mass.

With the external additive 12 containing the silica particles 12*a* coated with a nitrogen-containing resin (coat layers 12*b*), excessive charging of the toner can be restricted. Note that the nitrogen-containing resin refers to a resin having a chemical structure containing nitrogen atoms.

The nitrogen-containing resin contained in the coat layers 12*b* is preferably a thermosetting resin. The thermosetting resin tends to have high strength. Therefore, by the presence of the thermosetting resin in the coat layers 12*b*, the external additive 12 can improve the stress resistance of the toner.

Preferable examples of the nitrogen-containing resin contained in the coat layers 12*b* include amino resins, melamine resins, urea resins, polyamide resins, polyimide resins, polyamide-imide resin, aniline resins, guanamine resins, and polyurethane resins.

The melamine resin has a complex three-dimensional network structure and therefore has high degree of hardness and high durability. Also, the melamine resin is a thermosetting resin and therefore has high heat-resistance. Also, the melamine resin is a nitrogen-containing resin and therefore has high positive chargeability. Also, since the melamine resin is polymerized through dehydration condensation, the melamine resin readily bonds to a silane coupling agent or silica. Therefore, the use of a melamine resin as the nitrogen-containing resin in the coat layers 12*b* facilitates formation of the coat layers 12*b* having the silica particles 12*a* strongly bonded to the surface of the coat layers 12*b*. The features of the melamine resin described above are generally common to formaldehyde-based resins (melamine resins, urea resins, and phenolic resins). For this reason, formaldehyde-based resins are preferable as the nitrogen-containing resin contained in the coat layers 12*b*. In order to facilitate denaturation of resins or monomers of a resin, the use of a melamine resin or a urea resin as the nitrogen-containing resin contained in the coat layers 12*b* is particularly preferable. In order to improve the hardness and the positive chargeability of the coat layers 12*b*, melamine resins are particularly preferable.

Examples of melamine resins include a polycondensate of melamine and formaldehyde. For example, a melamine resin may be formed through the following method.

First, an addition reaction of melamine and formaldehyde is caused to yield a precursor of a melamine resin (methylol melamine molecules). Subsequently, a condensation reaction (cross-linking reaction) among the methylol melamine molecules is caused. As a result, an amino group of one methylol melamine molecule bonds to an amino group of another methylol melamine molecule via a methylene group. As a result, a melamine resin is obtained.

The methylol melamine can be altered in terms of its solubility in water by changing the type or number of functional groups of the methylol melamine. Due to the above, polymerization of methylol melamine in an aqueous medium is caused relatively easily.

Examples of urea resins include a polycondensate of urea and formaldehyde. For example, a urea resin may be formed by using urea instead of melamine in the above-described method of forming the melamine resin.

Examples of the positively chargeable treatment agent contained in the coat layers 12*b* include a silane coupling agent, alkoxysilane, alkoxy oligomer, and silicone oil.

The silane coupling agent is a compound formed from an organic component and silicon. Specifically, the silane coupling agent is an organosilicon compound having a reactive group and a hydrolyzable group. One reactive group and one to three hydrolyzable groups are bonded to one silicon atom (hereinafter, referred to a center silicon atom). When the number of hydrolyzable groups is less than 3, 3−n (where n is the number of hydrolyzable groups) methyl groups are bonded to a center silicon atom. Preferable examples of reactive groups include a group having a functional group such as an amino group, an epoxy group, a methacryl group, a vinyl group, a haloalkyl group, or a mercapto group at its end. Preferable examples of hydrolyzable groups include a group having a functional group such as an alkoxy group (specifically, $—OCH_3$ or $—OC_2H_5$), an acetoxy group, or a halogen group at its end. The silane coupling agent contains a reactive group and a hydrolyzable group in a molecule and therefore can act as an interface between organic and inorganic materials. The positively chargeable treatment agent contained in the coat layers 12*b* is preferably a silane coupling agent. The silane coupling agent tends to have a high solubility in water. The positively chargeable treatment agent contained in the coat layers 12*b* is preferably a silane coupling agent having an amino group. Examples of a silane coupling agent having an amino group include 3-aminopropyltriethoxysilane. In 3-aminopropyltriethoxysilane, one aminopropyl group (reactive group) and three ethoxy groups (each of which is a hydrolyzable group) are bonded to a center silicon atom.

Examples of the negatively chargeable agent contained in the coat layers 12*b* include a water-soluble sulfur-containing resin. In order to improve the charge stability of the toner, a preferable water-soluble sulfur-containing resin to be used is a copolymer of a monomer having a sulfo group and a hydroxy acrylic-based monomer. Preferable examples of a hydroxy acrylic-based monomer include 2-hydroxyethyl acrylate, 2-hydroxypropyl acrylate, and 2-hydroxypropyl methacrylate. Preferable examples of monomers having a sulfo group include ammonium p-styrenesulfonate, lithium p-styrenesulfonate, sodium styrenesulfonate, and potassium styrenesulfonate.

The coat layers 12*b* may contain a mixture of a nitrogen-containing resin and a water-soluble sulfur-containing resin. In this case, in order to improve the charge stability and durability of the toner, the amount of the water-soluble sulfur-containing resin in the coat layers 12*b* is preferably at least 2% by mass and no greater than 25% by mass, and more preferably at least 4% by mass and no greater than 20% by mass.

The coat layers 12*b* may contain a mixture of a nitrogen-containing resin and a water-soluble sulfur-containing resin.

In this case, in order to improve the charge stability and durability of the toner, the amount of the coat layers 12*b* is preferably at least 17% by mass and no greater than 80% by mass with respect to the total mass of the silica particles 12*a* and the coat layers 12*b*.

Preferably, the resin mixture contained in the coat layers 12*b* is formed directly on the surface of the silica particles 12*a*. Preferably, in addition, the resin mixture is chemically bonded to the silica particles 12*a*. The chemical bonds provide a strong adhesion between the coat layers 12*b* and the silica particles 12*a* that can be maintained over a long time.

In order to facilitate formation of the coat layers 12*b*, the nitrogen-containing resin and the chargeable treatment agent used to form the coat layers 12*b* each dissolve in a predetermined solvent (for example, an organic solvent or an aqueous solvent). For the toner having such composition, the coat layers 12*b* can be formed on the surface of the silica particles 12*a* through a reaction (polymerization) of materials of the coat layers 12*b* in a solvent in which the silica particles 12*a* are dispersed (reaction method). Also, the coat layers 12*b* may be formed on the surface of the silica particles 12*a* by applying a solution containing the coat layers 12*b* to the surface of the silica particles 12*a*, followed by removal of the solvent (solution applying method). The coat layers 12*b* formed by the reaction method is expected to provide a strong adhesion between the coat layer 12*b* and the silica particle 12*a* that can be maintained for a long period of time.

Preferably, the nitrogen-containing resin contained in the coat layers 12*b* is polymerlizable in an aqueous medium, and the chargeable treatment agent contained in the coat layers 12*b* is dissolvable in an aqueous medium. Through polymerization of the nitrogen-containing resin in an aqueous medium in which the chargeable treatment agent is dissolved, the resin mixture can be readily prepared.

[Method for Preparing External Additive]

According to the present embodiment, a method for manufacturing a toner (specifically, a method for preparing the external additive 12) involves preparing the silica particles 12*a*. Subsequently, the coat layers 12*b* containing a mixture of the nitrogen-containing resin and the chargeable treatment agent is formed on the surface of the silica particles 12*a*. The method for manufacturing a toner according to the present embodiment ensures manufacture of a favorable toner having excellent charge stability. The following describes an example of a method (reaction method) for preparing the external additives 12.

First, the silica particles 12*a* are dispersed in an aqueous medium in which the chargeable treatment agent is dissolved. As a result, a dispersion of the silica particles 12*a* is obtained. Subsequently, materials of the coat layers 12*b* (for example, the chargeable treatment agent and a monomer for forming the nitrogen-containing resin) are added to the dispersion of the silica particles 12*a*. The resultant dispersion is then heated to cause all the materials of the coat layers 12*b* in the dispersion to undergo reaction. Then, the dispersion is cooled to room temperature. Through the above, a dispersion of the external additive 12 (coarse particles) is obtained. The external additive 12 includes the silica particles 12*a* and the coat layers 12*b* formed on the surface of the respective silica particles 12*a*. The coat layers 12*b* contain a mixture of the nitrogen-containing resin and the chargeable treatment agent.

Subsequently, the dispersion of the external additive 12 is subjected to solid-liquid separation (for example, filtration) to extract the external additive 12 from the dispersion. The external additive 12 is then washed. The external additive 12 is then dried. The external additive 12 is then pulverized into particulates. Through the above, particulates of the external additive 12 are obtained. To efficiently prepare the external additive 12, it is preferable to prepare a large amount of the external additive 12 at the same time.

In the reaction method, while the dispersion of the silica particles 12*a* is stirred using a stirrer (for example, HIVIS MIX manufactured by PRIMIX Corporation), a monomer or prepolymer for forming the nitrogen-containing resin is caused to react (polymerize) in the dispersion.

For the coat layers 12*b* containing a melamine resin or a urea resin, the pH of the dispersion of the silica particles 12*a* is preferably adjusted to at least two and no greater than six prior to the formation of the coat layers 12*b* on the silica particles 12*a*. Through the pH adjustment of the dispersion to be more acidic than a neutral pH (pH7), the formation of the coat layers 12*b* can be accelerated.

For the coat layers 12*b* containing a melamine resin or a urea resin, the temperature for forming the coat layers 12*b* on the surface of the silica particles 12*a* is preferably at least 60° C. and no greater than 100° C. Through a reaction of the materials of the coat layer 12*b* caused at a temperature of at least 60° C. and no greater than 100° C., the formation of the coat layers 12*b* can be accelerated.

The following describes an example of the processes of the reaction method, namely, a washing process, a drying process, and an external addition process.

<Washing Process>

The external additive 12 can be washed with water. Preferable examples of the washing method include the following two methods. The first method involves filtering the dispersion of the external additive 12 to collect a wet cake of the external additive 12 and washing the obtained wet cake of the external additive 12 with water. The second method involves precipitating the external additive 12 contained in the dispersion, substituting the supernatant with water, and re-dispersing the external additive 12 in water.

<Drying Process>

After the washing process, the external additive 12 is dried. An example of the drying method of the external additive 12 involves the use of a drying apparatus, such as a spray dryer, a fluid bed dryer, a vacuum freeze dryer, or a reduced pressure dryer.

<Pulverization Method>

After the drying process, a coarse powder of the external additive 12 (an aggregate of coarse particles) is pulverized. An example of a pulverization method of the external additives 12 involves the use of a pulverizing apparatus, such as a continuous type surface modifier, a jet mill, or a mechanical pulverizer.

[External Addition Method]

The toner particles 10 are manufactured by adding the external additive 12 adhering to the surface of the external additive 12 (external addition). The following describes the external addition method according to the present embodiment.

An example of the external addition method involves mixing the toner mother particles 11 and the external additive 12 by using a mixer, such as FM mixer manufactured by Nippon Coke & Engineering Co., Ltd. or Nauta mixer (registered Japanese trademark) manufactured by Hosokawa Micron Corporation, under the conditions ensuring that the external additive 12 is not embedded in the toner mother particles 11.

[Two-Component Developer]

The toner according to the present embodiment may be mixed with a carrier to prepare a two-component developer.

To prepare a two-component developer, a magnetic carrier is preferably used. Preferable examples of the carrier include a carrier having resin-coated carrier cores. Examples of the carrier cores include: particles of metal such as iron, oxidized iron, reduced iron, magnetite, copper, silicon steel, ferrite, nickel, or cobalt; particles of alloys of one or more of the above-listed materials and a metal such as manganese, zinc, or aluminum; particles of iron-nickel alloys or iron-cobalt alloys; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and particles of high-dielectric substances, such as ammonium dihydrogen phosphate, potassium dihydrogen phosphate, or Rochelle salt. The carrier may also be a resin carrier having any of the above listed particles dispersed therein.

Examples of the resin coating the carrier cores include acrylic-based resins, styrene-based resins, styrene-(meth) acrylic copolymers, olefin-based resins (specifically, polyethylene, chlorinated polyethylene, and polypropylene), polyvinyl chlorides, polyvinyl acetates, polycarbonate, cellulose resins, polyester resins, unsaturated polyester resins, polyamide resins, polyurethane resins, epoxy resins, silicone resins, fluororesins (specifically, polytetrafluoroethylene, polychlorotrifluoroethylene, and polyvinylidene fluoride), phenolic resins, xylene resins, diallyl phthalate resins, polyacetal resins, and amino resins. Two or more of the above-listed resins may be used in combination.

The number average particle diameter of the carrier measured under an electron microscope is preferably at least 20 μm and no greater than 120 μm, and more preferably at least 25 μm and no greater than 80 μm.

The content of the toner is preferably at least 3 parts by mass and no greater than 20 parts by mass with respect to 100 parts by mass of the two-component developer, and more preferably at least 5 parts by mass and no greater than 15 parts by mass.

[Method for Preparing Two-Component Developer]

A preferable example of a method for preparing a two-component developer involves mixing a toner and a carrier by using a mixer, such as a ball mill.

Examples

The following describes Examples of the present disclosure. Specifically, two sets of evaluations (Evaluation 1 and Evaluation 2) were made. The following sequentially describes Evaluation 1 and Evaluation 2.

Evaluation 1

The following describes Evaluation 1. Table 1 shows toners A-1 to A-15 (each being a toner for developing an electrostatic image) subjected to Evaluation 1.

TABLE 1

| Toner | Silica (Positively Chargeable Treatment Agent) | Coat Layer: Positively Chargeable Treatment Agent | Coat Layer: Coating Material | Ratio by Mass (Silica:Positively Chargeable Treatment Agent:Coating Material) |
|---|---|---|---|---|
| A-1 | Silica A | Treatment Agent A | Coating Material A | 50:10:40 |
| A-2 | Silica A | Treatment Agent A | Coating Material A | 50:5:45 |
| A-3 | Silica A | Treatment Agent A | Coating Material A | 50:30:20 |
| A-4 | Silica A | Treatment Agent A | Coating Material A | 50:20:80 |
| A-5 | Silica A | Treatment Agent B | Coating Material A | 50:10:40 |
| A-6 | Silica A | Treatment Agent A | Coating Material B | 50:10:40 |
| A-7 | Silica A | Treatment Agent A | Coating Material C | 50:10:40 |
| A-8 | Silica B | Treatment Agent A | Coating Material A | 50:4.5:18 |
| A-9 | Silica C | Treatment Agent A | Coating Material A | 50:7.5:30 |
| A-10 | Silica A | Treatment Agent A | Coating Material A | 50:30:120 |
| A-11 | Silica A | Treatment Agent A | Coating Material A | 50:40:160 |
| A-12 | Silica A | — | — | 50:0:0 |
| A-13 | Silica A | Treatment Agent A | — | 50:10:0 |
| A-14 | Silica D (Treatment Agent C) | — | — | 50:5:0 |
| A-15 | Silica D (Treatment Agent C) | — | Coating Material A | 50:5:40 |

With reference mainly to Table 1, the following describes the methods for preparing the toners A-1 to A-15. [Preparation Method of Toner A-1]

First, 50 g of silica A (silica particles) was dispersed in 500 mL of ion exchanged water. The silica A was water-soluble fumed silica particles having a specific surface area of 200 $m^2/g$ (AEROSIL (registered Japanese trademark) 200 manufactured by Nippon Aerosil Co., Ltd.).

Subsequently, the pH of the resultant dispersion of silica particles was adjusted to fall within a range of 3 to 4 through the addition of 0.5 N aqueous hydrochloric acid (087-01076 (Wako 1st Grade) manufactured by Wako Pure Chemical Industries, Ltd.).

After the pH adjustment, 40 g of a coating material A (material of the coat layers) and 10 g of a treatment agent A (positively chargeable treatment agent) were dissolved in the dispersion of silica particles. The coating material A used herein was water-soluble methylol melamine (Nikaresin (registered Japanese trademark) S-260 manufactured by Nippon Carbide Industries Co., Inc.), which was a precursor of a melamine resin. The treatment agent A used herein was 3-aminopropyltriethoxysilane (KBE-903 manufactured by Shin-Etsu Chemical Co., Ltd.).

Next, the resultant solution was transferred to a separable flask of 1 L capacity. The contents of the flask were then reacted at 70° C. for 30 minutes using a constant temperature bath (BK400 manufactured by Yamato Scientific Co., Ltd.). As a result, a precipitate was obtained in the flask.

Next, the precipitate was filtered and dried using a vacuum dryer (Square Vacuum Drying Oven DP43/63 manufactured by Yamato Scientific Co., Ltd.). As a result, coarse particles of the dried external additive were obtained.

Subsequently, the coarse particles of the external additive were pulverized using a supersonic jet pulverizer (PJM-805P manufactured by Nippon Pneumatic Mfg. Co., Ltd.). As a result, the external additive was obtained.

Subsequently, 2 parts by mass of the external additive prepared in the above manner and 100 parts by mass of toner mother particles (cyan toner (prior to the external addition) for TASKa1fa5550 manufactured by KYOCERA Document Solutions Inc.) were mixed by using a multi-purpose compact mixing mill (multi-purpose mixer manufactured by Nippon Coke & Engineering Co., Ltd.). Through the above, a large number of toner particles of the toner A-1 were obtained.

[Method for Preparing Toner A-2]

The toner A-2 was prepared through the same preparation method as the toner A-1 except that the ratio by mass of the silica A (silica particles), the treatment agent A (positively chargeable treatment agent), and the coating material A (material of the coat layers) was changed. Specifically, in the method for preparing the toner A-2, 5 g of the treatment agent A and 45 g of the coating material A were added to 50 g of the silica A.

[Method for Preparing Toner A-3]

The toner A-3 was prepared through the same preparation method as the toner A-1 except that the ratio by mass of the silica A (silica particles), the treatment agent A (positively chargeable treatment agent), and the coating material A (material of the coat layers) was changed. Specifically, in the method for preparing the toner A-3, 30 g of the treatment agent A and 20 g of the coating material A were added to 50 g of the silica A.

[Method for Preparing Toner A-4]

The toner A-4 was prepared through the same preparation method as the toner A-1 except that the ratio by mass of the silica A (silica particles), the treatment agent A (positively chargeable treatment agent), and the coating material A (material of the coat layers) was changed. Specifically, in the method for preparing the toner A-4, 20 g of the treatment agent A and 80 g of the coating material A were added to 50 g of the silica A.

[Method for Preparing Toner A-5]

The toner A-5 was prepared through the same preparation method as the toner A-1 except that a treatment agent B (positively chargeable treatment agent) was used instead of the treatment agent A. The treatment agent B was N-phenyl-3-aminopropyltrimethoxysilane (KBM-573 manufactured by Shin-Etsu Chemical Co., Ltd.).

[Method for Preparing Toner A-6]

The toner A-6 was prepared through the same preparation method as the toner A-1 except that a coating material B (material of the coat layers) was used instead of the coating material A. The coating material B was urea-formaldehyde (MIRBANE (registered Japanese trademark) resin SU-100 manufactured by Showa Denko K.K.), which was a precursor of a urea resin.

[Method for Preparing Toner A-7]

The toner A-7 was prepared through the same preparation method as the toner A-1 except that a coating material C (material of the coat layers) was used instead of the coating material A. The coating material C used herein was water-soluble methylol melamine (Nikaresin (registered Japanese trademark) S-176 manufactured by Nippon Carbide Industries Co., Inc.).

[Method for Preparing Toner A-8]

The toner A-8 was prepared through the same preparation method as the toner A-1 except that silica B (silica particles) was used instead of the silica A and that the ratio by mass of the silica B, the treatment agent A (positively chargeable treatment agent), and the coating material A (material of the coat layers) was changed. The silica B was water-soluble fumed silica having a specific surface area of 90 $m^2/g$ (AEROSIL (registered Japanese trademark) 90 manufactured by Nippon Aerosil Co., Ltd.). Specifically, in the method for preparing the toner A-8, 4.5 g of the treatment agent A and 18 g of the coating material A were added to 50 g of the silica B.

[Method for Preparing Toner A-9]

The toner A-9 was prepared through the same preparation method as the toner A-1 except that silica C (silica particles) was used instead of the silica A and that the ratio by mass of the silica C, the treatment agent A (positively chargeable treatment agent), and the coating material A (material of the coat layers) was changed. The silica C was precipitated silica particles (Nipsil (registered Japanese trademark) E-220A manufactured by Tosoh Silica Corporation) having a specific surface area of 150 $m^2/g$. Specifically, in the method for preparing the toner A-9, 7.5 g of the treatment agent A and 30 g of the coating material A were added to 50 g of the silica C.

[Method for Preparing Toner A-10]

The toner A-10 was prepared through the same preparation method as the toner A-1 except that the ratio by mass of the silica A (silica particles), the treatment agent A (positively chargeable treatment agent), and the coating material A (material of the coat layers) was changed. Specifically, in the method for preparing the toner A-10, 30 g of the treatment agent A and 120 g of the coating material A were added to 50 g of the silica A.

[Method for Preparing Toner A-11]

The toner A-11 was prepared through the same preparation method as the toner A-1 except that the ratio by mass of the silica A (silica particles), the treatment agent A (positively chargeable treatment agent), and the coating material A (material of the coat layers) was changed. Specifically, in the method for preparing the toner A-11, 40 g of the treatment agent A and 160 g of the coating material A were added to the 50 g of the silica A.

[Method for Preparing Toner A-12]

The toner A-12 was prepared through same preparation method as the toner A-1 except that neither the positively chargeable treatment agent nor the coating material (the materials of the coat layers) was used. In the toner A-12, no coat layers were formed on the surface of the silica particles.

[Method for Preparing Toner A-13]

The toner A-13 was prepared through same preparation method as the toner A-1 except that the coating material (the materials of the coat layers) was not used. In the preparation method of the toner A-13, the surface of the silica particles was treated with the positively chargeable treatment agent such that the coat layers composed exclusively of the positively chargeable treatment agent were formed on the surface of the silica particles. That is, the coating material was not contained in the coat layers formed on the surface of the silica particles.

[Method for Preparing Toner A-14]

In the preparation method of the toner A-14, amino-denatured silicone oil (treatment agent C) was used for the surface treatment of the silica A. The silica A after the surface treatment (hereinafter, referred to as silica D) was used as the external additive. The coating material (material of the coat layers) was not used. The following describes the method for preparing the toner A-14.

First, 5 g of amino-denatured silicone oil (KF-859 manufactured by Shin-Etsu Chemical Co., Ltd.) was dissolved in 500 mL of hexane (082-00426 (Wako 1st Grade) manufactured by Wako Pure Chemical Industries, Ltd.), followed by dispersing 50 g of the silica A (silica particles) therein.

Subsequently, the resultant dispersion of the silica particles was dried under reduced pressure while being heated to 70° C. As a result, an aggregate of the silica particles was obtained.

Subsequently, the aggregate of the silica particles was pulverized using a supersonic jet pulverize (PJM-805P manufactured by Nippon Pneumatic Mfg. Co., Ltd.). As a result, the silica D (external additive) was obtained.

Subsequently, 2 parts by mass of the silica D and 100 parts by mass of toner mother particles (cyan toner (prior to the external addition) for TASKalfa5550 manufactured by KYOCERA Document Solutions Inc.) were mixed by using a multi-purpose compact mixing mill (Multi-purpose Mixer manufactured by Nippon Coke & Engineering Co., Ltd.). Through the above, a large number of toner particles of the toner A-14 were obtained.

[Method for Preparing Toner A-15]

The toner A-15 was prepared through the same preparation method as the toner A-1 except the following.

In the preparation method of the toner A-15, the silica D was used instead of the silica A. In the preparation method of the toner A-15, 40 g of the coating material A was added to 55 g of the silica D (the silica particles accounted for 50 g of 55 g). In the preparation method of the toner A-15, no positively chargeable treatment agent was added to the coating material A (material of the coat layers).

[Evaluation Method]

Samples (toners A-1 to A-15) were evaluated in the following method.

(Particle Diameter of External Additive)

The median diameter $D_{50}$ (volume distribution standard) of the external additive was measured using a laser diffraction particle diameter distribution analyzer device (LA-950V2 manufactured by HORIBA, Ltd.).

(Toner Fluidity)

To measure the bulk density of the toner, 20 g of the sample (toner) was charged into a suspended bulk density measurement device (MVD-86 manufactured by Tsutsui Scientific Instruments Co., Ltd.).

The toner with the bulk density of 0.40 g/mL or more was evaluated as Very Good, the toner with the bulk density of at least 0.30 g/mL and less than 0.40 g/mL was evaluated as Good, and the toner with the bulk density of less than 0.30 g/mL was evaluated as Poor.

(Fogging Density)

First, 100 parts by mass of a carrier (carrier for TASKalfa5550 manufactured by KYOCERA Document Solutions Inc.) and 10 parts by mass of the sample (toner) were mixed for 30 minutes by using a ball mill (NT-1S/KN3324070 manufactured by Tech Jam Co., Ltd.). Through the above process, an evaluation developer (two-component developer) was obtained.

A color multifunction peripheral (TASKalfa5550 manufactured by KYOCERA Document Solutions Inc.) was used as an evaluation apparatus. The evaluation developer was left to stand for 24 hours at an ambient temperature of 20° C. and relative humidity (RH) of 60%, and then charged into a cyan development unit of the evaluation apparatus. In addition, the replenishment toner (sample) was charged into a cyan toner container in the evaluation apparatus.

Subsequently, the evaluation apparatus was operated to successively produce blank printing (print of blank image) on a predetermined number (15, 5,000, or 10,000) of recording mediums (sheet of paper) in an environment of an ambient temperature of 20° C. and a relative humidity (RH) of 60%. Subsequently, a predetermined evaluation pattern (image) having a coverage rate of 5% was printed on a recording medium.

In a manner described above, a sample image including a solid portion and a blank portion was printed on a recording medium after 15 prints, 5,000 prints, and 10,000 prints. Subsequently, a reflection densitometer (Color Reflection Densitometer R710 manufactured by IHARA Electronic Industries Co., Ltd.) was used to measure the reflection density of the blank portion of the sample image printed on the recording medium and of base paper, which was a recording medium not subjected to printing (non-printed paper). Next, the fogging density (FD) was calculated using the following formula.

FD=(Reflectively of Blank Portion)−(Reflectivity of Non-Printed Paper)

The fogging density (FD) of less than 0.01 was evaluated as Good. The fogging density (FD) of 0.01 or more was evaluated as Poor.

(Charge Amount)

First, 100 parts by mass of a carrier (carrier for TASKalfa5550 manufactured by KYOCERA Document Solutions Inc.) and 10 parts by mass of the sample (toner) were mixed for 30 minutes by using a ball mill (NT-1S/KN3324070 manufactured by Tech Jam Co.). As a result, an evaluation developer (two-component developer) was obtained.

The charge amount was measured for a "first evaluation developer" referring to an evaluation developer left to stand for 24 hours in an environment of an ambient temperature of 20° C. and a relative humidity (RH) of 60% and a "second evaluation developer" referring to an evaluation developer left to stand for 24 hours in an environment of an ambient temperature of 28° C. and a relative humidity (RH) of 80%. The charge amount was measured using a portable charge measurement device that uses a "draw off" method (Model 212HS manufactured by TREK, INC.).

In addition, the difference in charge amount between the two environments was calculated by using the following formula.

Difference in Charge Amount between Two environments=(Charge Amount of First Evaluation Developer)−(Charge Amount of Second Evaluation Developer)

As for the first evaluation developer, the charge amount of 40 μC/g or more was evaluated as Very Good, the charge amount of at least 20 μC/g and less than 40 μC/g was evaluated as Good, and the charge amount of less than 20 μC/g was evaluated as Poor.

As for the second evaluation developer, the charge amount of 30 μC/g or more was evaluated as Very Good, the charge amount of at least 12 μC/g and less than 30 μC/g was evaluated as Good, and the charge amount of less than 12 μC/g was evaluated as Poor.

As for the difference in charge amount between the two environments, the difference of 5 μC/g or less was evaluated as Very Good, the difference of at least 5 μC/g and less than 12 μC/g was evaluated as Good, and the difference of 12 μC/g or more was evaluated as Poor.

[Evaluation Results]

Table 2 gathers the evaluation results of the particle diameter of each external additive and the fluidity (bulk density) of each toner.

TABLE 2

| Toner | Particle Diameter of External Additive (nm) | Bulk Density of Toner (g/mL) |
|---|---|---|
| A-1 | 21 | 0.42 |
| A-2 | 21 | 0.45 |
| A-3 | 21 | 0.37 |
| A-4 | 30 | 0.41 |
| A-5 | 21 | 0.44 |
| A-6 | 21 | 0.42 |
| A-7 | 21 | 0.38 |
| A-8 | 23 | 0.47 |
| A-9 | 19 | 0.42 |

TABLE 2-continued

| Toner | Particle Diameter of External Additive (nm) | Bulk Density of Toner (g/mL) |
|---|---|---|
| A-10 | 34 | 0.36 |
| A-11 | 35 | 0.33 |
| A-12 | 21 | 0.22 |
| A-13 | 23 | 0.29 |
| A-14 | 25 | 0.33 |
| A-15 | 25 | 0.33 |

For each of the toners A-4, A-10, and A-11, the particle diameter of the external additive was at least 30 nm. For each of the toners A-1 to A-3, A-5 to A-9, and A-12 to A-15, the particle diameter of the external additive was less than 30 nm.

For each of the toners A-1, A-2, A-4 to A-6, A-8, and A-9, the bulk density of the toner was at least 0.40 g/mL. For each of the toners A-3, A-7, A-10, A-11, A-14, and A-15, the bulk density of the toner was at least 0.30 g/mL and less than 0.40 g/mL. For each of the toners A-12 and A-13, the bulk density of the toner was less than 0.30 g/mL.

The evaluation results on the toners A-1, A-4, A-10, and A-11 lead to the assumption that the particle diameter of the external additive increases with an increase in the total amount of the resin mixture (the treatment agent A and the coating material A).

Table 3 gathers the evaluation results on the fogging densities (FD).

TABLE 3

| Toner | Fogging Density | | |
|---|---|---|---|
| | After 15 Prints | After 5,000 Prints | After 10,000 Prints |
| A-1 | 0.003 | 0.004 | 0.003 |
| A-2 | 0.002 | 0.002 | 0.003 |
| A-3 | 0.004 | 0.004 | 0.003 |
| A-4 | 0.003 | 0.002 | 0.004 |
| A-5 | 0.004 | 0.002 | 0.002 |
| A-6 | 0.008 | 0.004 | 0.002 |
| A-7 | 0.003 | 0.002 | 0.003 |
| A-8 | 0.004 | 0.002 | 0.004 |
| A-9 | 0.005 | 0.005 | 0.003 |
| A-10 | 0.004 | 0.005 | 0.005 |
| A-11 | 0.002 | 0.002 | 0.003 |
| A-12 | 0.042 | 0.039 | 0.043 |
| A-13 | 0.033 | 0.015 | 0.008 |
| A-14 | 0.032 | 0.021 | 0.018 |
| A-15 | 0.028 | 0.016 | 0.013 |

For each of the toners A-1 to A-11, the fogging density (FD) was less than 0.01 on a print produced at any time. For each of the toners A-12, A-14, and A-15, the fogging density (FD) was more than 0.01 on any of the prints produced at the respective times. For the toner A-13, the fogging density (FD) was more than 0.01 at the initial stages (after completion of 15 prints and 5,000 prints), and less than 0.01 after completion of 10,000 prints.

The evaluation results on the toners A-1 and A-5 lead to the assumption that the fogging density (FD) can be kept low regardless of the type of the positively chargeable treatment agent (treatment agent A or B) used.

The evaluation results on the toners A-1, A-6, and A-7 lead to the assumption that the fogging density (FD) can be kept low regardless of the type of the nitrogen-containing resin (the coating material A, B, or C) used.

The evaluation results on the toners A-1 to A-4, A-8, and A-9 lead to the assumption that the fogging density (FD) can be kept low regardless of the type of the silica particles (silica A, B, or C) used.

The evaluation results on the toners A-12 to A-14 lead to the assumption that the fogging density (FD) tends to be high in the absence of coat layers containing a nitrogen-containing resin.

The evaluation results on the toner A-15 lead to the assumption that the fogging density (FD) tends to be high in the absence of a mixture of a nitrogen-containing resin and a positively chargeable treatment agent in the coat layers.

Table 4 gathers the evaluation results of the charge amount of the first evaluation developer, the charge amount of the second evaluation developer, and the difference in charge amount between the two environments.

TABLE 4

| Toner | Charge Amount (μC/g) | | Charge Amount Difference Between Two Environments (μC/g) |
|---|---|---|---|
| | 20° C./60% RH | 28° C./80% RH | |
| A-1 | 38.3 | 33.8 | 4.5 |
| A-2 | 33.2 | 30.0 | 3.2 |
| A-3 | 48.1 | 37.3 | 10.8 |
| A-4 | 40.5 | 38.4 | 2.1 |
| A-5 | 30.6 | 28.4 | 2.2 |
| A-6 | 40.3 | 30.1 | 10.2 |
| A-7 | 35.8 | 28.5 | 7.3 |
| A-8 | 35.7 | 31.8 | 3.9 |
| A-9 | 43.2 | 40.4 | 2.8 |
| A-10 | 40.8 | 38.9 | 1.9 |
| A-11 | 41.3 | 39.5 | 1.8 |
| A-12 | 12.0 | 4.0 | 8.0 |
| A-13 | 39.1 | 16.7 | 22.4 |
| A-14 | 22.9 | 10.5 | 12.4 |
| A-15 | 25.5 | 14.1 | 11.4 |

For each of the toners A-1, A-2, A-4, A-5, A-8, A-9, A-10, and A-11, the difference in charge amount between the two environments is less than 5 μC/g. For each of the toners A-3, A-6, A-7, A-12, and A-15, the difference in charge amount between the two environments is at least 5 μC/g and less than 12 μC/g. For each of the toners A-13 and A-14, the difference in charge amount between the two environments is 12 μC/g or more.

Out of the toners A-1 to A-15, the toner A-12 was the only toner corresponding to the first evaluation developer resulted in the charge amount of less than 20 μC/g. In addition, out of the toners A-1 to A-15, the toners A-12 and A-14 were the only toners corresponding to the second evaluation toner resulted in the charge amount of less than 12 μC/g.

The evaluation results of the toners A-1 to A-3 lead to the assumption that the charge amount of the toner increases with an increase in the amount of the positively chargeable treatment agent (treatment agent A).

The evaluation results on the toners A-1 to A-4, A-8, and A-9 lead to the assumption that the difference in charge amount between the two environments can be kept small regardless of the type of the silica particles (silica A, B, or C) used.

The evaluation results of the toners A-1 and A-5 lead to the assumption that the difference in charge amount between the two environments can be kept small regardless of the type of the positively chargeable treatment agent (treatment agent A or B) used.

The evaluation results on the toners A-1, A-6, and A-7 lead to the assumption that the difference in charge amount between the two environments can be kept small regardless of the type of the nitrogen-containing resin (coating material A, B, or C) used.

The evaluation results of the toners A-12 to A-14 lead to the assumption that the charge amount or the charge stability of the toner is reduced in the absence of coat layers containing a nitrogen-containing resin.

As has been described above, a plurality of toner particles were included in each of the toners A-1 to A-11 (toners of Examples of the present embodiment). Each toner particle had a toner mother particle and an external additive adhering to a surface of the toner mother particle. For each of the toners A-1 to A-11, the external additive included silica particles and coat layers on the surface of the respective silica particles. For each of the toners A-1 to A-11, the coat layers contained a mixture (resin mixture) of a nitrogen-containing resin (a resin formed from either the coating material A, B or C) and the positively chargeable treatment agent (treatment agent A or B).

The coat layers of each of the toners A-1 to A-11 contained a resin mixture. In each of the toners A-1 to A-11, the external additive was therefore assumed to have high hydrophobicity and high positive chargeability. In each of the toners A-1 to A-11, in addition, the resin mixture contained a thermosetting nitrogen-containing resin (coating materials). Therefore, each of the toners A-1 to A-11 is assumed to have high stress resistance, high hardness, and high fluidity. Each of the toners A-1 to A-11 had excellent charge stability. Each of the toners A-1 to A-11 was used to form images with a low tendency of causing fogging.

In each of the toners A-1 to A-11, the resin mixture (nitrogen-containing resin and positively chargeable treatment agent) contained in the coat layers resided directly on the surface of the silica particles. In the method for preparing each of the toners A-1 to A-11, the coating material A, B, or C used was polymerizable in an aqueous medium. In each of the method for preparing the toners A-1 to A-11, the positively chargeable treatment agent used was dissolvable in an aqueous medium.

Evaluation 2

The following describes Evaluation 2. Tables 5 and 6 each show the toners B-1 to B-23 (each being a toner for developing an electrostatic image) subjected to Evaluation 2.

TABLE 5

| | Silica | | First Coating Material | | Second Coating Material | |
|---|---|---|---|---|---|---|
| Toner | Type | Additive Amount (g) | Type | Additive Amount (g) | Type | Additive Amount (g) |
| B-1 | A | 50 | A | 45.0 | CCR-A | 5 |
| B-2 | C | 50 | A | 45.0 | CCR-A | 5 |
| B-3 | B | 50 | A | 45.0 | CCR-A | 5 |
| B-4 | A | 50 | B | 45.0 | CCR-A | 5 |
| B-5 | A | 50 | A | 45.0 | CCR-B | 5 |
| B-6 | A | 50 | A | 40.0 | CCR-A | 10 |
| B-7 | A | 50 | A | 40.0 | CCR-B | 10 |
| B-8 | A | 50 | A | 48.0 | CCR-A | 2 |
| B-9 | A | 50 | A | 48.0 | CCR-B | 2 |
| B-10 | A | 50 | A | 9.0 | CCR-A | 1 |
| B-11 | A | 50 | A | 9.0 | CCR-B | 1 |
| B-12 | A | 50 | A | 180.0 | CCR-A | 20 |
| B-13 | A | 50 | A | 180.0 | CCR-B | 20 |
| B-14 | A | 50 | A | 35.0 | CCR-A | 15 |
| B-15 | A | 50 | A | 35.0 | CCR-B | 15 |
| B-16 | A | 50 | A | 49.5 | CCR-A | 0.5 |
| B-17 | A | 50 | A | 49.5 | CCR-B | 0.5 |
| B-18 | A | 50 | A | 4.5 | CCR-A | 0.5 |
| B-19 | A | 50 | A | 4.5 | CCR-B | 0.5 |
| B-20 | A | 50 | A | 270.0 | CCR-A | 30 |
| B-21 | A | 50 | A | 270.0 | CCR-B | 30 |
| B-22 | A | 50 | — | — | — | — |
| B-23 | A | 50 | — | — | Organic Silane | 10 |

TABLE 6

| Toner | Coat Layer Sulfur-Containing Resin (wt %) | External Additive Coat Layer (wt %) | Particle Diameter (nm) |
|---|---|---|---|
| B-1 | 10 | 50 | 22 |
| B-2 | 10 | 50 | 19 |
| B-3 | 10 | 50 | 21 |
| B-4 | 10 | 50 | 21 |
| B-5 | 10 | 50 | 23 |
| B-6 | 20 | 50 | 24 |
| B-7 | 20 | 50 | 23 |
| B-8 | 4 | 50 | 21 |
| B-9 | 4 | 50 | 21 |
| B-10 | 10 | 17 | 29 |
| B-11 | 10 | 17 | 30 |
| B-12 | 10 | 80 | 33 |
| B-13 | 10 | 80 | 31 |
| B-14 | 30 | 50 | 25 |
| B-15 | 30 | 50 | 25 |
| B-16 | 1 | 50 | 20 |
| B-17 | 1 | 50 | 21 |
| B-18 | 10 | 9 | 31 |
| B-19 | 10 | 9 | 31 |
| B-20 | 10 | 86 | 37 |
| B-21 | 10 | 86 | 39 |
| B-22 | — | — | 21 |
| B-23 | — | — | 23 |

As shown in Table 5, each of the toners B-1 to B-21 was prepared by using a material for forming a nitrogen-containing resin (first coating material) and a material for forming a water-soluble sulfur-containing resin (second coating material). The following now describes a method for synthesizing each of the second coating materials (CCR-A and CCR-B) used for preparing a corresponding one of the toners B-1 to B-21.

(CCR-A)

A separable flask of 1 L capacity equipped with an agitator, a condenser, and a thermometer was used as a reaction vessel. The reaction vessel was charged with 20 g of sodium vinyl sulfonate (V0043 manufactured by Tokyo Chemical Industry Co., Ltd.), 100 g of sodium acrylate (Na-AA manufactured by Asada Chemical Industry Co., Ltd.), 10 g of 2,2'-azobis(2-methylpropionamidine)dihydrochloride (V-50 manufactured by Wako Pure Chemical Industries, Ltd.), and 500 g of ion exchanged water. Subsequently, the reaction vessel was placed over a mantle heater, and the contents of the vessel were stirred at 60° C. for 1 hour to cause reaction. After the reaction, the contents of the vessel were cooled. Subsequently, the contents of the vessel were added to 30 L of ethanol (manufactured by Wako Pure Chemical Industries, Ltd.) to obtain a solid-containing liquid (specifically, ethanol containing a white solid). Subsequently, the resultant solid-containing liquid was subjected to solid-liquid separation (specifically, filtration). Subsequently, the solid isolated by the filtration was dried to obtain powder of a water-soluble copolymer of sodium vinyl sulfonate and sodium acrylate (CCR-A).

(CCR-B)

A separable flask of 1 L capacity equipped with an agitator, a condenser, and a thermometer was used as a reaction vessel. The reaction vessel was charged with 20 g of ammonium p-styrenesulfonate (manufactured by Tosoh Corporation), 100 g of hydroxyethyl methacrylate, 10 g of 2,2'-azobis(2-methylpropionamidine)dihydrochloride (V-50 manufactured by Wako Pure Chemical Industries, Ltd.), and 500 g of ion exchanged water. Subsequently, the reaction vessel was placed over a mantle heater, and the contents of the vessel were stirred at 60° C. for 1 hour to cause a reaction. After the reaction, the contents of the vessel were cooled. Subsequently, the contents of the vessel were added to 30 L of ethanol (manufactured by Wako Pure Chemical Industries, Ltd.) to obtain a solid-containing liquid (specifically, ethanol containing a white solid). Subsequently, the resultant solid-containing liquid was subjected to solid-liquid separation (specifically, filtration). Subsequently, the solid isolated by the filtration was dried to obtain powder of a water-soluble copolymer of sodium vinyl sulfonate and sodium acrylate (CCR-B).

[Method for Preparing Toner B-1]

First, 50 g of water-soluble fumed silica particles (AEROSIL (registered Japanese trademark) 200 manufactured by Nippon Aerosil Co., Ltd.) was dispersed in 500 mL of ion exchanged water. Subsequently, the pH of the resultant dispersion of silica particles was adjusted to fall in a range of 3 to 4 (acidic pH) through the addition of 0.5 N aqueous hydrochloric acid (manufactured by Wako Pure Chemical Industries, Ltd.). Subsequently, 45 g of methylolmelamine (Nikaresin (registered Japanese trademark) S-260 manufactured by Nippon Carbide Industries Co., Inc.), which was a precursor of a melamine resin, and 5 g of the CCR-A aqueous solution were dissolved in the resultant dispersion of silica particles. As a result, a liquid (liquid mixture) containing the silica particles, the first coating material (methylolmelamine), and the second coating material (CCR-A) was obtained. In the following description, the water-soluble fumed silica particles (AEROSIL (registered Japanese trademark) 200 manufactured by Nippon Aerosil Co., Ltd.) is referred to as the silica A. In addition, methylolmelamine (Nikaresin (registered Japanese trademark) S-260 manufactured by Nippon Carbide Industries Co., Inc.) is referred to as the first coating material A.

The resultant mixture liquid was transferred to a separable flask of 1 L capacity. The contents of the flask were then reacted at 70° C. for 30 minutes using a constant temperature bath (BK400 manufactured by Yamato Scientific Co., Ltd.). As a result, a liquid containing a precipitate was obtained.

Subsequently, the precipitate was isolated from the liquid through filtration. Subsequently, the resultant precipitate was dried using a square vacuum dryer (DP43/63 manufactured by Yamato Scientific Co., Ltd.) to obtain a dry matter. The resultant dry matter was pulverized using a supersonic jet pulverize (PJM-805P manufactured by Nippon Pneumatic Mfg. Co., Ltd.). As a result, the external additive was obtained.

Subsequently, 2 parts by mass of the resultant external additive and 100 parts by mass of the cyan toner (cyan toner (prior to the external addition) for TASKalfa5550 manufactured by KYOCERA Document Solutions Inc.) were mixed by using a multi-purpose compact mixing mill (Multi-Purpose Mixer manufactured by Nippon Coke & Engineering Co., Ltd.). As a result, a large number of toner particles of the toner B-1 were obtained.

[Method for Preparing Toner B-2]

The toner B-2 was prepared through the same preparation method as the toner B-1 except that the silica C was used instead of the silica A to prepare the external additive. The silica C was precipitated silica particles (Nipsil (registered Japanese trademark) E-220A manufactured by Tosoh Silica Corporation) having a specific surface area of 150 $m^2/g$.

[Method for Preparing Toner B-3]

The toner B-3 was prepared through the same preparation method as the toner B-1 except that silica B was used instead of the silica A to prepare the external additive. The silica B was water-soluble fumed silica particles (AEROSIL (registered Japanese trademark) 90 manufactured by Nippon Aerosil Co., Ltd.) having a specific surface area of 90 $m^2/g$.

[Method for Preparing Toner B-4]

The toner B-4 was prepared through the same preparation method as the toner B-1 except that the first coating material B was used instead of the first coating material A to prepare the external additive. The first coating material B was a precursor of a urea resin (MIRBANE (registered Japanese trademark) resin SU-100 manufactured by Showa Denko K.K.).

[Method for Preparing Toner B-5]

The toner B-5 was prepared through the same preparation method as the toner B-1 except that the second coating material used to prepare the external additive was CCR-B instead of CCR-A.

[Method for Preparing Toner B-6]

The toner B-6 was prepared through the same preparation method as the toner B-1 except that the additive amount of CCR-A was 10 g instead of 5 g and that the additive amount of the first coating material A was 40 g instead of 45 g.

[Method for Preparing Toner B-7]

The toner B-7 was prepared through the same preparation method as the toner B-1 except that 10 g of CCR-B was used instead of 5 g of CCR-A and that the additive amount of the first coating material A was 40 g instead of 45 g.

[Method for Preparing Toner B-8]

The toner B-8 was prepared through the same preparation method as the toner B-1 except that the additive amount of CCR-A was 2 g instead of 5 g and that the additive amount of the first coating material A was 48 g instead of 45 g.

[Method for Preparing Toner B-9]

The toner B-9 was prepared through the same preparation method as the toner B-1 except that 2 g of CCR-B was used instead of 5 g of CCR-A and that the additive amount of the first coating material A was 48 g instead of 45 g.

[Method for Preparing Toner B-10]

The toner B-10 was prepared through the same preparation method as the toner B-1 except that the additive amount of CCR-A was 1 g instead of 5 g and that the additive amount of the first coating material A was 9 g instead of 45 g.

[Method for Preparing Toner B-11]

The toner B-11 was prepared through the same preparation method as the toner B-1 except that 1 g of CCR-B was used instead of 5 g of CCR-A and that the additive amount of the first coating material A was 9 g instead of 45 g.

[Method for Preparing Toner B-12]

The toner B-12 was prepared through the same preparation method as the toner B-1 except that the additive amount of CCR-A was 20 g instead of 5 g and that the additive amount of the first coating material A was 180 g instead of 45 g.

[Method for Preparing Toner B-13]

The toner B-13 was prepared through the same preparation method as the toner B-1 except that 20 g of CCR-B was used instead of 5 g of CCR-A and that the additive amount of the first coating material A was 180 g instead of 45 g.

[Method for Preparing Toner B-14]

The toner B-14 was prepared through the same preparation method as the toner B-1 except that the additive amount of CCR-A was 15 g instead of 5 g and that the additive amount of the first coating material A was 35 g instead of 45 g.

[Method for Preparing Toner B-15]

The toner B-15 was prepared through the same preparation method as the toner B-1 except that 15 g of CCR-B was used instead of 5 g of CCR-A and that the additive amount of the first coating material A was 35 g instead of 45 g.

[Method for Preparing Toner B-16]

The toner B-16 was prepared through the same preparation method as the toner B-1 except that the additive amount of CCR-A was 0.5 g instead of 5 g and that the additive amount of the first coating material A was 49.5 g instead of 45 g.

[Method for Preparing Toner B-17]

The toner B-17 was prepared through the same preparation method as the toner B-1 except that 0.5 g of CCR-B was used instead of 5 g of CCR-A and that the additive amount of the first coating material A was 49.5 g instead of 45 g.

[Method for Preparing Toner B-18]

The toner B-18 was prepared through the same preparation method as the toner B-1 except that the additive amount of CCR-A was 0.5 g instead of 5 g and that the additive amount of the first coating material A was 4.5 g instead of 45 g.

[Method for Preparing Toner B-19]

The toner B-19 was prepared through the same preparation method as the toner B-1 except that 0.5 g of CCR-B was used instead of 5 g of CCR-A and that the additive amount of the first coating material A was 4.5 g instead of 45 g.

[Method for Preparing Toner B-20]

The toner B-20 was prepared through the same preparation method as the toner B-1 except that the additive amount of CCR-A was 30 g instead of 5 g and that the 45 g of the first coating material A was 270 g instead of 45 g.

[Method for Preparing Toner B-21]

The toner B-21 was prepared through the same preparation method as the B-1 except that 30 g of CCR-B was used instead of 5 g of CCR-A and that the additive amount of the first coating material A was 270 g instead of 45 g.

[Method for Preparing Toner B-22]

The toner B-22 was prepared through the same preparation method as the toner B-1 except that the silica A was used directly as the external additive. In the preparation method of the toner B-22, neither the first coating material nor the second coating material was used.

[Method for Preparing Toner B-23]

The toner B-23 was prepared through the same preparation method as the toner B-1 except that 10 g of 3-aminopropyltriethoxysilane (KBE-903 manufactured by Shin-Etsu Chemical Co., Ltd.) was used instead of 5 g of CCR-A and that the first coating material was not used.

[Evaluation Method]

Samples (toner B-1 to B-23) were evacuated in the following method.

First, 100 parts by mass of a carrier (carrier for TASKalfa5550 manufactured by KYOCERA Document Solutions Inc.) and 10 parts by mass of the sample (toner) were mixed for 30 minutes using a powder mixer (Rocking Mixer (registered Japanese trademark) manufactured by Aichi Electric Co., Ltd.). As a result, an evaluation developer (two-component developer) was obtained. The resultant evaluation developers were used to evaluate the respective samples (toners B-1 to B-23) for the environmental stability of the charge amount and the printing durability.

(Environmental Stability of Charge Amount)

The charge amount was measured for a "first evaluation developer" referring to an evaluation developer left to stand for 24 hours in an environment of an ambient temperature of 20° C. and a relative humidity (RH) of 60% (N environment), and a "third evaluation developer" referring to an evaluation developer left to stand for 24 hours in an environment of an ambient temperature of 10° C. and a relative humidity (RH) of 20% (L environment). The charge amount was measured using a Q/m meter (Model 210HS manufactured by TREK, INC.). Specifically, toner was separated from 0.10 g of the evaluation developer using a draw-off unit of the Q/m meter, and the charge amount of the evaluation developer was calculated based on the amount of the toner separated and the readings of the Q/m meter. In addition, the ratio of the third evaluation developer relative to the first evaluation developer in terms of the charge amount (hereinafter, referred to as the environmental change rate of the charge amount) was calculated.

With respect to the charge amount, the environmental change rate of 1.7 or more was evaluated as Poor, the environmental change rate of at least 1.3 and less than 1.7 was evacuated as Good, and the environmental change rate of less than 1.3 was evacuated as Very Good.

(Printing Durability)

A color multifunction peripheral (TASKalfa5550 manufactured by KYOCERA Document Solutions Inc.) was used as an evaluation apparatus. The evaluation developer was charged into a cyan development unit of the evaluation apparatus and the sample (toner) was charged into a cyan toner container of the evaluation apparatus.

The printing durability test was conducted using the above-described evaluation apparatus by successively producing 5,000 prints of an image having a coverage rate of 1% in an environment of an ambient temperature of 20° C. and a relative humidity (RH) of 60%. Thereafter, the evaluation apparatus was used to print a sample image including a solid portion and a blank portion on a recording medium. Then, the image density, the fogging density, and the charge amount of the toner were evaluated based on the sample image printed on the recording medium.

The image density (ID) of the solid portion and the fogging density (FD) of the blank portion were measured using a Macbeth reflection densitometer (RD914 manufactured by Sakata Inx Eng. Co., Ltd.). The measurement of the fogging density (FD) involves measurement of the reflection density of the blank portion of the sample image printed on the recording medium and the reflection density of base paper, which was a recording medium not subjected to printing (non-printed paper). Then, the fogging density (FD) was calculated by the following formula.

FD=(Reflectively at Blank Portion)−(Reflectivity at Non-Printed Paper)

The fogging density (FD) of less than 0.015 was evaluated as Good. The fogging density (FD) of 0.015 or more was evacuated as Poor.

After the printing durability test, toner was separated from 0.10 g of the evaluation developer using a draw-off unit of a Q/m meter (Model 210HS manufactured by TREK, INC.), and the charge amount of the evaluation developer was calculated based on the amount of the separated toner and the readings of the Q/m meter. Then, the ratio of increase (charge increasing ratio) from the charge amount (initial charge amount) of the first evaluation developer (N environment) to the charge amount after the printing durability test (post-durability-test charge amount) was calculated.

Charge Increasing Ratio=Post-Durability-Test Charge Amount/Initial Charge Amount (Fogging Due to Toner Replenishment)

After the printing durability test of producing a print of an image having a coverage rate of 1%, 15 prints of an image having a coverage rate of 10% were produced. The fogging density was measured for each print. The greatest value of the measured fogging densities was taken as an evaluation value of fogging due to toner replenishment. Note that the amount of toner supplied to replenish the development unit increases when a print of a high coverage rate image is initiated after a low coverage rate image is produced over a long period of time.

The fogging due to toner replenishment was evaluated as Very Good when the evaluation value was less than 0.01. The fogging due to toner replenishment was evaluated as Good when the evaluation value was at least 0.01 and less than 0.02. The fogging density due to toner replenishment was evacuated as Poor when the evaluation value was 0.02 or more.

Table 7 gathers evaluation results of each of the samples (toners B-1 to B-23).

TABLE 7

| | Charge Amount | | | Durability Test | | | | |
|---|---|---|---|---|---|---|---|---|
| Toner | N Environment [μC/g] | L Environment [μC/g] | Rate of Change (L/N) | ID | FD | Charge Amount | Charge Increasing Rate | Fogging due to Replenishment |
| B-1 | 31.2 | 39.6 | 1.27 | 1.35 | 0.002 | 40.2 | 1.29 | 0.002 |
| B-2 | 34.7 | 45.1 | 1.30 | 1.29 | 0.003 | 44.1 | 1.27 | 0.003 |
| B-3 | 33.2 | 43.8 | 1.32 | 1.22 | 0.003 | 44.2 | 1.33 | 0.003 |
| B-4 | 26.8 | 38.6 | 1.44 | 1.22 | 0.004 | 37.8 | 1.41 | 0.007 |
| B-5 | 39.3 | 53.1 | 1.35 | 1.28 | 0.002 | 52.3 | 1.33 | 0.002 |
| B-6 | 17.8 | 21.5 | 1.21 | 1.43 | 0.007 | 21.9 | 1.23 | 0.004 |
| B-7 | 22.4 | 28.4 | 1.27 | 1.39 | 0.005 | 29.3 | 1.31 | 0.003 |
| B-8 | 38.1 | 56.4 | 1.48 | 1.18 | 0.002 | 58.3 | 1.53 | 0.004 |
| B-9 | 42.4 | 64.0 | 1.51 | 1.15 | 0.003 | 66.6 | 1.57 | 0.002 |
| B-10 | 27.3 | 35.5 | 1.30 | 1.32 | 0.004 | 36.0 | 1.32 | 0.007 |
| B-11 | 30.1 | 39.7 | 1.32 | 1.36 | 0.002 | 40.6 | 1.35 | 0.006 |
| B-12 | 33.2 | 44.5 | 1.34 | 1.29 | 0.003 | 45.8 | 1.38 | 0.002 |
| B-13 | 35.1 | 48.4 | 1.38 | 1.30 | 0.003 | 50.5 | 1.44 | 0.002 |
| B-14 | 13.2 | 15.3 | 1.16 | 1.43 | 0.011 | 15.0 | 1.14 | 0.014 |
| B-15 | 15.2 | 18.2 | 1.20 | 1.39 | 0.009 | 18.5 | 1.22 | 0.016 |
| B-16 | 40.3 | 63.7 | 1.58 | 1.02 | 0.002 | 64.9 | 1.61 | 0.003 |
| B-17 | 44.5 | 73.4 | 1.65 | 0.99 | 0.003 | 72.1 | 1.62 | 0.005 |
| B-18 | 25.4 | 35.1 | 1.38 | 1.36 | 0.003 | 34.3 | 1.35 | 0.015 |
| B-19 | 27.1 | 36.6 | 1.35 | 1.29 | 0.001 | 37.1 | 1.37 | 0.013 |
| B-20 | 30.1 | 39.7 | 1.32 | 1.11 | 0.003 | 51.8 | 1.72 | 0.002 |
| B-21 | 31.0 | 40.6 | 1.31 | 1.14 | 0.003 | 52.4 | 1.69 | 0.002 |
| B-22 | 15.2 | 24.6 | 1.62 | 1.27 | 0.020 | 25.5 | 1.68 | 0.018 |
| B-23 | 44.5 | 81.4 | 1.83 | 1.20 | 0.002 | 61.4 | 1.38 | 0.036 |

As shown in Table 7, each of the toners B-1 to B-21 (toners of Examples of the present embodiment) had excellent charge stability and durability. For each of the toners B-1 to B-21, the external additive included silica particles and coat layers on the surface of the respective silica particles. For each of the toners B-1 to B-21, the coat layers contained a mixture (resin mixture) of a nitrogen-containing resin (melamine resin or urea resin) and a negatively chargeable treatment agent (water-soluble sulfur-containing resin having negative chargeability).

Each of the toners B-1 to B-13 was particularly excellent in the charge amount, the charge stability, and the durability. As shown in Table 6, for each of the toners B-1 to B-13, the amount of a water-soluble sulfur-containing resin contained in the coat layers was at least 4% by mass and no greater than 20% by mass. As shown in Table 6, for each of the toners B-1 to B-13, the amount of the coat layers was at least 17% by mass and no greater than 80% by mass with respect to the total mass of the silica particles and the coat layers.

What is claimed is:

1. A positively chargeable toner, comprising:

a plurality of toner particles each having a toner mother particle and an external additive adhering to a surface of the toner mother particle, wherein the external additive contains silica particles and coat layers on a surface of the respective silica particles, and the coat layers contain a mixture of a nitrogen-containing resin and a chargeable treatment agent.

2. A positively chargeable toner according to claim 1, wherein the chargeable treatment agent is a silane coupling agent.

3. A positively chargeable toner according to claim 2, wherein the silane coupling agent contains an amino group.

4. A positively chargeable toner according to claim 3, wherein the silane coupling agent is 3-aminopropyltriethoxysilane.

5. A positively chargeable toner according to claim 1, wherein the chargeable treatment agent contains a water-soluble sulfur-containing resin.

6. A positively chargeable toner according to claim 5, wherein the water-soluble sulfur-containing resin is a copolymer of a monomer having a sulfo group and a hydroxy acrylic-based monomer.

7. A positively chargeable toner according to claim 5, wherein an amount of the coat layers is at least 17% by mass and no greater than 80% by mass with respect to a total mass of the silica particles and the coat layers.

8. A positively chargeable toner according to claim 5, wherein an amount of the water-soluble sulfur-containing resin contained in the coat layers is at least 4% by mass and no greater than 20% by mass.

9. A positively chargeable toner according to claim 1, wherein the mixture resides directly on the surface of the silica particles.

10. A positively chargeable toner according to claim 1, wherein the nitrogen-containing resin is polymerizable in an aqueous medium, and the chargeable treatment agent is dissolvable in the aqueous medium.

11. A positively chargeable toner according to claim 1, wherein the nitrogen-containing resin is a thermosetting resin.

12. A positively chargeable toner according to claim 11, wherein the thermosetting resin is a melamine resin or a urea resin.

13. A positively chargeable toner according to claim 1, wherein the coat layers contain the mixture in an amount of at least 80% by mass.

14. A method for manufacturing a positively chargeable toner, the positively chargeable toner containing a plurality of toner particles each having a toner mother particle, and an external additive adhering to a surface of the toner mother particle, the method comprising:

preparing silica particles to be contained in the external additive, and forming, on a surface of each of the silica particles, a coat layer containing a mixture of a nitrogen-containing resin and a chargeable treatment agent.

15. A method for manufacturing a positively chargeable toner according to claim 14, wherein the forming the coat layer involves polymerizing the nitrogen-containing resin in an aqueous medium in which the chargeable treatment agent has been dissolved.

* * * * *